US009168736B2

(12) United States Patent
Takahashi

(10) Patent No.: US 9,168,736 B2
(45) Date of Patent: Oct. 27, 2015

(54) RECORDING DEVICE, METHOD OF CONTROLLING A RECORDING DEVICE, AND STORAGE MEDIUM STORING A PROGRAM EXECUTED BY A CONTROL UNIT THAT CONTROLS A RECORDING DEVICE

(75) Inventor: Hideaki Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 148 days.

(21) Appl. No.: 13/598,958

(22) Filed: Aug. 30, 2012

(65) Prior Publication Data

US 2013/0050325 A1 Feb. 28, 2013

(30) Foreign Application Priority Data

Aug. 31, 2011 (JP) ..... 2011-189160

(51) Int. Cl.
*B41J 29/38* (2006.01)
*B41J 2/045* (2006.01)

(52) U.S. Cl.
CPC ..... *B41J 2/0451* (2013.01); *B41J 2/04551* (2013.01); *B41J 2/04563* (2013.01); *B41J 2/04581* (2013.01)

(58) Field of Classification Search
CPC .... B41J 2/0458; B41J 2/04563; B41J 29/393; B41J 2/04591; B41J 2/04581; B41J 2/0451; B41J 2/04551
See application file for complete search history.

(56) References Cited

U.S. PATENT DOCUMENTS

| | | | | |
|---|---|---|---|---|
| 6,547,361 | B1 * | 4/2003 | Suzuki et al. | 347/19 |
| 7,334,859 | B2 | 2/2008 | Kojima | |
| 7,393,077 | B2 | 7/2008 | Kusakari | |
| 7,594,709 | B2 | 9/2009 | Kojima | |
| 2005/0046658 | A1 * | 3/2005 | Kojima | 347/19 |
| 2009/0225128 | A1 * | 9/2009 | Kuroda et al. | 347/23 |
| 2010/0156983 | A1 * | 6/2010 | Tamaki | 347/16 |
| 2010/0295886 | A1 * | 11/2010 | Aruga | 347/14 |
| 2012/0229547 | A1 * | 9/2012 | Miura | 347/14 |

FOREIGN PATENT DOCUMENTS

| | | | |
|---|---|---|---|
| JP | 2005-053047 | A | 3/2005 |
| JP | 2005-119071 | A | 5/2005 |
| JP | 2005-313625 | A | 11/2005 |
| JP | 2006-168152 | A | 6/2006 |
| JP | 2006-198924 | A | 8/2006 |
| JP | 2006-205742 | A | 8/2006 |

* cited by examiner

*Primary Examiner* — Alessandro Amari
*Assistant Examiner* — Jeremy Delozier
(74) *Attorney, Agent, or Firm* — Nutter McClennen & Fish LLP; John J. Penny, Jr.; Joshua I. Rudawitz

(57) ABSTRACT

The time required for a nozzle check is minimized without reducing the accuracy of the nozzle check. An inkjet line printer has a nozzle check control unit that performs a nozzle check to detect ejection problems in the nozzles of plural nozzle rows of the inkjet line head. The nozzle check control unit applies the nozzle check to a portion of the nozzles in the group of nozzles in a specific range where two mutually overlapping nozzle rows overlap.

10 Claims, 8 Drawing Sheets

RECORDING DEVICE, METHOD OF CONTROLLING A RECORDING DEVICE, AND STORAGE MEDIUM STORING A PROGRAM EXECUTED BY A CONTROL UNIT THAT CONTROLS A RECORDING DEVICE

This application claims priority under 35 U.S.C. §119 to Japanese Patent Application No. 2011-189160 filed on Aug. 31, 2011, the entire disclosure of which is expressly incorporated by reference herein.

BACKGROUND

1. Technical Field

The present invention relates to a recording device having a recording head with a plurality of nozzle rows, a method of controlling the recording device, and a program for controlling the recording device.

2. Related Art

Recording devices (printers) that can perform a nozzle check to detect ejection problems in the nozzles of the recording head are known from the literature. See, for example, Japanese Unexamined Patent Appl. Pub. JP-A-2006-198924.

There is a tendency in recording devices that are designed to perform a nozzle check for the time required to perform the nozzle check to become relatively long compared to the time actually spent on recording by the recording head, particularly when the recording head has a large number of nozzles. Shortening the time required for the nozzle check as much as possible without lowering the accuracy of the nozzle check is therefore desirable.

SUMMARY

With consideration for this problem, an object of the present invention is to minimize the time required for a nozzle check without reducing the accuracy of the nozzle check.

One aspect of the invention is a recording device having a conveyance unit that conveys a recording medium; a recording head having a plurality of nozzle rows formed with nozzles aligned in a direction intersecting the conveyance direction of the recording medium; and a nozzle check control unit that performs a nozzle check that detects ejection problems in nozzles of the plural nozzle rows of the recording head; wherein the recording head has the nozzle rows disposed separated in the conveyance direction so that different nozzle rows overlap in a specific range in a direction intersecting the conveyance direction; and the nozzle check control unit applies the nozzle check to a portion of the nozzles in the group of nozzles in the specific range.

When different nozzle rows of the recording head are disposed separated in the conveyance direction so that they overlap in a specific range in a direction intersecting the conveyance direction as in the recording device described above, there may be nozzles in this specific range of overlap that are not used when recording. Because the nozzle check is applied to a portion of the nozzles in the group of nozzles in this specific range of overlap, a process that does not check the nozzles that are not used when recording on the recording medium can be performed. As a result, the time required for the nozzle check can be shortened while assuring the accuracy of the nozzle check and the ability of the recording head to record.

Preferably, the recording device according to another aspect of the invention also has a recording control unit that controls the recording head to record on the recording medium; and the nozzle check control unit identifies for the nozzle check the nozzles in the group of nozzles in the specific range that are not used by the recording control unit to record on the recording medium, and applies the nozzle check to at least a portion of the nozzles not including the identified nozzles.

Because the nozzles in the specific overlapping range are not used for recording to the recording medium, nozzles that do not need to be checked for ejection problems are not checked in the nozzle check. As a result, the time required for the nozzle check can be shortened while assuring the accuracy of the nozzle check and the ability of the recording head to record.

A recording device according to another aspect of the invention preferably also has an independent ejection mode in which ink is ejected in the specific range by nozzles in only one of the overlapping nozzle rows when recording by the recording control unit; and when the independent ejection mode is selected when the nozzle check is performed, the nozzle check control unit applies the nozzle check to at least a portion of the nozzles in the nozzle row that ejects ink in the specific range.

Because this aspect of the invention does not check the nozzles that are not used in the independent ejection mode, the time required for the nozzle check can be shortened while assuring the accuracy of the nozzle check by applying the nozzle check to the nozzles that are used to record on the recording medium.

Further preferably in a recording device according to another aspect of the invention, the recording head has the nozzle row for one color and the nozzle row for another color that can compensate for the one color disposed separated in the conveyance direction at corresponding positions in the direction intersecting the conveyance direction; and when an ejection problem is not detected in the nozzle with a compensating relationship to a nozzle of the one color, the nozzle check control unit removes the nozzle of the one color from the group of nozzles to be checked, and in the group of nozzles contained in the nozzle row of the one color and the overlapping nozzle row of the other color, applies the nozzle check to a portion of the nozzles in the group of nozzles in the specific range.

When a nozzle of one color and a nozzle of another color are in a compensating relationship, an ejection problem occurs in the nozzle of the one color, and there is no ejection problem with the nozzle of the other color in the compensating relationship, a compensating dot is formed by the nozzle of the other color for the dot that should be formed by the nozzle of the one color. A nozzle check of the nozzle of the one color is therefore not necessary when there is no ejection problem with the nozzle of the other color. Because this aspect of the invention does not apply the nozzle check to the nozzle of the one color when there is no need to detect ejection problems in the nozzle of the one color, the time required for the nozzle check can be shortened while assuring the accuracy of the nozzle check by applying the nozzle check to the nozzles that are used to record on the recording medium.

The recording device according to another aspect of the invention preferably also has a width detection unit that detects the width of the recording medium. The nozzle check control unit identifies the nozzles located outside the range of the recording area on the recording medium based on the recording medium width detected by the width detection unit before performing the nozzle check, and after removing the identified nozzles from the group of nozzles to be checked, applies the nozzle check to a portion of the nozzles in the group of nozzles in the specific range of the nozzles contained in the different mutually overlapping nozzle rows.

Nozzles that are located outside the range of the recording area on the recording medium are not used. The recording area can also change with the width of the recording medium. This aspect of the invention detects the width of the recording medium, identifies the nozzles that are outside the recording area of the recording medium based on the recording medium width, and does not apply the nozzle check to these identified nozzles. As a result, the time required for the nozzle check can be shortened while assuring the accuracy of the nozzle check by applying the nozzle check to the nozzles that are used to record on the recording medium.

Another aspect of the invention is a method of controlling a recording device having a conveyance unit that conveys a recording medium, a recording head having a plurality of nozzle rows formed with nozzles aligned in a direction intersecting the conveyance direction of the recording medium, and a nozzle check control unit that performs a nozzle check that detects ejection problems in nozzles of the plural nozzle rows of the recording head, wherein the recording head has the nozzle rows disposed separated in the conveyance direction so that different nozzle rows overlap in a specific range in a direction intersecting the conveyance direction, and the control method has a step of: applying the nozzle check to a portion of the nozzles in the group of nozzles in the specific range.

When different nozzle rows of the recording head are disposed separated in the conveyance direction so that they overlap in a specific range in a direction intersecting the conveyance direction as in the recording device described above, there may be nozzles in this specific range of overlap that are not used when recording. Because this control method applies the nozzle check to a portion of the nozzles in the group of nozzles in this specific range of overlap, a process that does not check the nozzles that are not used when recording on the recording medium can be performed. As a result, the time required for the nozzle check can be shortened while assuring the accuracy of the nozzle check and the ability of the recording head to record.

Another aspect of the invention is a computer-readable recording medium recording a program that is executed by a control unit that controls a recording device having a conveyance unit that conveys a recording medium, and a recording head having a plurality of nozzle rows formed with nozzles aligned in a direction intersecting the conveyance direction of the recording medium, wherein: the recording head has the nozzle rows disposed separated in the conveyance direction so that different nozzle rows overlap in a specific range in a direction intersecting the conveyance direction; and the control unit functions as a nozzle check control unit that performs a nozzle check that detects ejection problems in nozzles of the plural nozzle rows of the recording head, and applies the nozzle check to a portion of the nozzles in the group of nozzles in the specific range.

When different nozzle rows of the recording head are disposed separated in the conveyance direction so that they overlap in a specific range in a direction intersecting the conveyance direction as in the recording device described above, there may be nozzles in this specific range of overlap that are not used when recording. Because the nozzle check is applied by executing this program to a portion of the nozzles in the group of nozzles in this specific range of overlap, a process that does not check the nozzles that are not used when recording on the recording medium can be performed. As a result, the time required for the nozzle check can be shortened while assuring the accuracy of the nozzle check and the ability of the recording head to record.

Effect of the Invention

The invention can minimize the time required for the nozzle check without lowering the accuracy of the nozzle check.

DESCRIPTION OF EMBODIMENTS

A preferred embodiment of the present invention is described below with reference to the accompanying figures.

Figure 1:
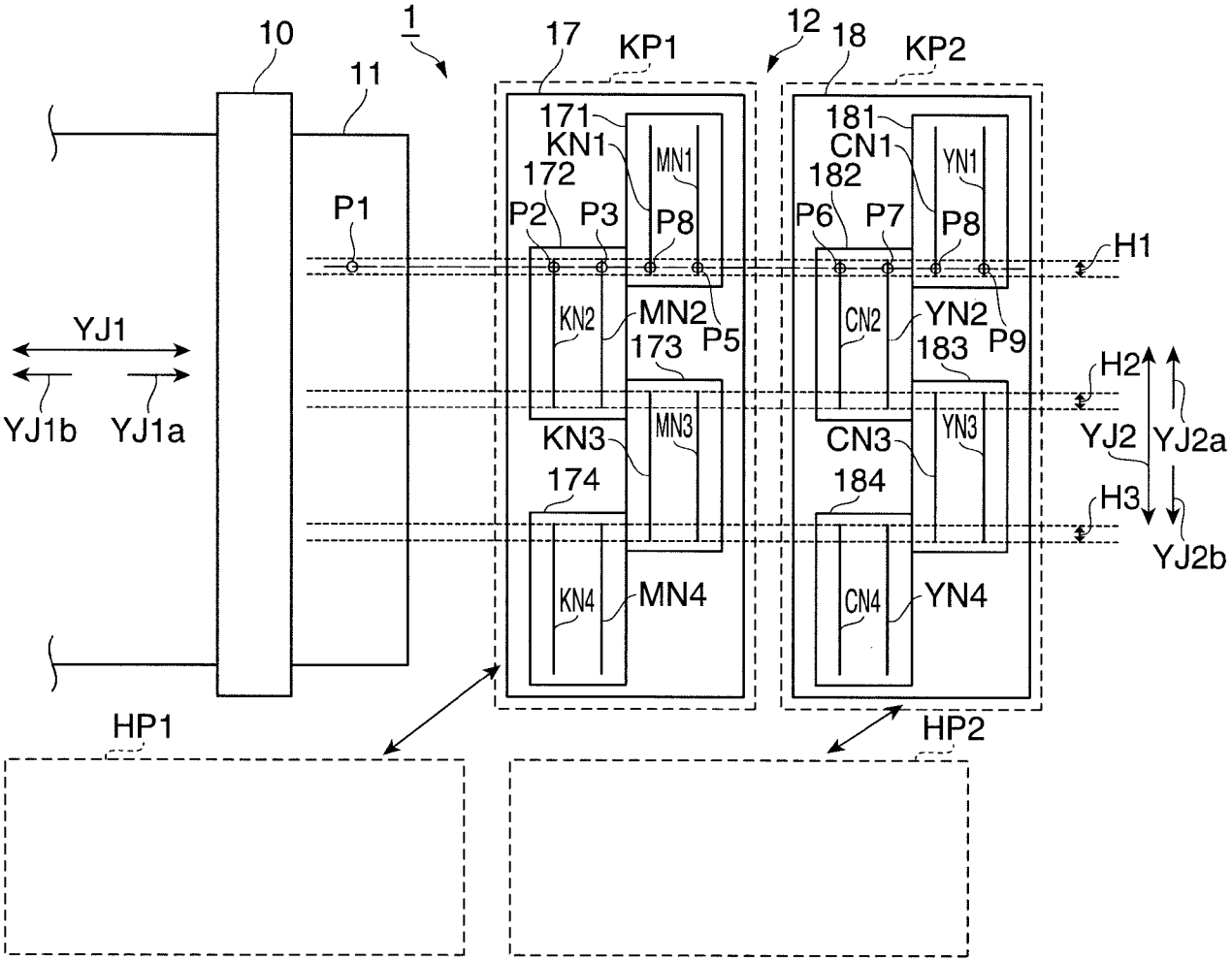
FIG. 1 shows the configuration of an inkjet line printer.

FIG. 1 describes the configuration of an inkjet line printer 1 (recording device) according to this embodiment of the invention.

The inkjet line printer 1 is an inkjet printer with a line printhead that records images by ejecting ink from an inkjet line head 12 having a plurality of nozzle rows, which extend in a nozzle row direction YJ2 that is perpendicular to the media conveyance direction YJ1, while conveying the recording medium 11 in the forward conveyance direction YJ1*a* using a paper feed roller 10 (conveyance unit) to form dots on the recording medium 11.

As shown in FIG. 1, the inkjet line head 12 has an upstream head unit 17 (a recording head on the upstream side of the inkjet line head 12), and a downstream head unit 18 (a recording head on the downstream side of the inkjet line head 12).

The upstream head unit 17 has four recording heads that are staggered in a zigzag pattern from the left side in the forward conveyance direction YJ1*a*, specifically a first upstream recording head 171 (a downstream-side recording head on the upstream head unit 17), a second upstream recording head 172 (an upstream-side recording head on the upstream head unit 17), a third upstream recording head 173 (a downstream-side recording head on the upstream head unit 17), and a fourth upstream recording head 174 (an upstream-side recording head on the upstream head unit 17).

The downstream head unit 18 likewise has four recording heads that are staggered in a zigzag pattern from the left side in the forward conveyance direction YJ1*a*, specifically a first downstream recording head 181 (downstream-side recording head on the downstream head unit 18), a second downstream recording head 182 (an upstream-side recording head on the downstream head unit 18), a third downstream recording head 183 (a downstream-side recording head on the downstream head unit 18), and a fourth downstream recording head 184 (an upstream-side recording head on the downstream head unit 18).

The first upstream recording head 171 of the upstream head unit 17 has a black nozzle row KN1 an a magenta nozzle row MN1 disposed downstream in the forward conveyance direction YJ1*a* (below simply "downstream") from the black nozzle row KN1. The area in which the black nozzle row KN1 extends in the nozzle row direction YJ2, and the area in which the magenta nozzle row MN1 extends in the nozzle row direction YJ2, are the same.

The black nozzle row KN1 is a row of nozzles formed along the nozzle row direction YJ2 that ejects ink as fine ink droplets (liquid drops). Ink is supplied from a black (K) ink cartridge (not shown in the figure) to black nozzle rows KN. The first upstream recording head 171 pushes ink from the black (K) ink cartridge toward the recording medium 11 using actuators made with piezoelectric devices, for example, and ejects fine ink droplets from specific nozzles.

Like the black nozzle row KN1, the magenta nozzle row MN1 is a row of nozzles formed in the nozzle row direction YJ2, and has ink supplied from a magenta (M) ink cartridge (not shown in the figure).

The second upstream recording head 172 is configured identically to the first upstream recording head 171, and has a black nozzle row KN2 for ejecting black (K) ink, and a magenta nozzle row MN2 for ejecting magenta (M) ink disposed downstream from the black nozzle row KN2.

As shown in FIG. 1, the nozzle rows formed in the first upstream recording head 171, and the nozzle rows formed in the second upstream recording head 172, overlap in area H1 in the nozzle row direction YJ2. This overlap is provided to prevent the unsightly appearance of white streaks formed by the uneven separation of dots in the area corresponding to the border between dots formed on the recording medium 11 by the first upstream recording head 171 and dots formed on the recording medium 11 by the second upstream recording head 172.

The third upstream recording head 173 is identical to the second upstream recording head 172, and has a black nozzle row KN3 and a magenta nozzle row MN3 located downstream from the black nozzle row KN3.

As also shown in FIG. 1, the nozzle rows of the third upstream recording head 173 and the nozzle rows of the second upstream recording head 172 overlap in area H2 in the nozzle row direction YJ2.

The fourth upstream recording head 174 is identical to the third upstream recording head 173, and has a black nozzle row KN4 and a magenta nozzle row MN4 located downstream from the black nozzle row KN4.

As also shown in FIG. 1, the nozzle rows of the fourth upstream recording head 174 and the nozzle rows of the third upstream recording head 173 overlap in area H3 in the nozzle row direction YJ2.

As also shown in FIG. 1, black nozzle row KN1 in the first upstream recording head 171 and black nozzle row KN3 in the third upstream recording head 173 are at the same position in the conveyance direction YJ1. Likewise, magenta nozzle row MN1 and magenta nozzle row MN3, black nozzle row KN2 and black nozzle row KN4, and magenta nozzle row MN2 and magenta nozzle row MN4, are at the same positions in the conveyance direction YJ1.

The first downstream recording head 181 of the downstream head unit 18 has a cyan nozzle row CN1 and a yellow nozzle row YN1 located downstream from cyan nozzle row CN1. Ink is supplied from a cyan (C) ink cartridge to cyan nozzle row CN1, and ink is supplied from a yellow (Y) ink cartridge to yellow nozzle row YN1. The area covered by cyan nozzle row CN1 in the nozzle row direction YJ2, and the area covered by yellow nozzle row YN1 in the nozzle row direction YJ2, are the same. Cyan nozzle row CN1 and yellow nozzle row YN1 also cover the same range in the nozzle row direction YJ2 as black nozzle row KN1 and magenta nozzle row MN1 in the first upstream recording head 171 of the upstream head unit 17.

The second downstream recording head 182 is configured identically to the first downstream recording head 181, and has a cyan nozzle row CN2 for ejecting cyan (C) ink, and a yellow nozzle row YN2 for ejecting yellow ink downstream from the cyan nozzle row CN2.

Cyan nozzle row CN2 and yellow nozzle row YN2 also cover the same range in the nozzle row direction YJ2 as black nozzle row KN2 and magenta nozzle row MN2 in the second upstream recording head 172 of the upstream head unit 17.

The nozzle rows of the first downstream recording head 181 also overlap the nozzle rows of the second downstream recording head 182 in area H1 in the nozzle row direction YJ2.

The third downstream recording head 183 is configured identically to the second downstream recording head 182, and has a cyan nozzle row CN3 for ejecting cyan (C) ink, and a yellow nozzle row YN3 for ejecting yellow ink downstream from the cyan nozzle row CN3.

Cyan nozzle row CN3 and yellow nozzle row YN3 also cover the same range in the nozzle row direction YJ2 as black nozzle row KN3 and magenta nozzle row MN3 in the third upstream recording head 173 of the upstream head unit 17.

The nozzle rows of the second downstream recording head 182 also overlap the nozzle rows of the third downstream recording head 183 in area H2 in the nozzle row direction YJ2.

The fourth downstream recording head 184 is configured identically to the third downstream recording head 183, and has a cyan nozzle row CN4 for ejecting cyan (C) ink, and a yellow nozzle row YN4 for ejecting yellow ink downstream from the cyan nozzle row CN4.

Cyan nozzle row CN4 and yellow nozzle row YN4 also cover the same range in the nozzle row direction YJ2 as black nozzle row KN4 and magenta nozzle row MN4 in the fourth upstream recording head 174 of the upstream head unit 17.

The nozzle rows of the second downstream recording head 182 also overlap the nozzle rows of the fourth downstream recording head 184 in area H3 in the nozzle row direction YJ2.

In the downstream head unit 18 as shown in FIG. 1, cyan nozzle row CN1 and cyan nozzle row CN3, cyan nozzle row CN2 and cyan nozzle row CN4, yellow nozzle row YN1 and yellow nozzle row YN3, and yellow nozzle row YN2 and yellow nozzle row YN4 are at the same positions in the conveyance direction YJ1.

The upstream head unit 17 and downstream head unit 18 are mounted on separate carriages (not shown in the figure). The upstream head unit 17 can be moved to home position HP1 shown in FIG. 1 by the carriage, and the downstream head unit 18 can be moved to home position HP2. Flushing, capping, and the nozzle check described below are performed at home positions HP1 and HP2.

The inkjet line printer 1 ejects ink and forms dots on the recording medium 11, and records images from combinations of dots. The inkjet line printer 1 has two operating modes, an independent ejection mode and a combined ejection mode, and forms dots differently in each mode.

The basic operation of the inkjet line printer 1 when forming dots on the recording medium 11 is described separately below for when the operating mode is set to the independent ejection mode and when set to the combined ejection mode. Note that the following description describes an example in which the recording medium 11 is set to the position shown in FIG. 1 and a dot of a specific color is formed at position P1 on the recording medium 11. This specific color is a color that is expressed by ejecting specific amounts of black (K), cyan (C), yellow (Y), and magenta (M) ink. As shown in FIG. 1, position P1 is located in area H1 in the nozzle row direction YJ2.

Independent Ejection Mode

The independent ejection mode is a mode in which when a specific color of ink is ejected in the area where different nozzle rows that eject the same specific color of ink overlap, only one of those nozzle rows ejects ink. For example, when black (K) ink is ejected in the independent ejection mode, ink is ejected from only one of black nozzle row KN1 and black nozzle row KN2 in area H1 where black nozzle row KN1 and black nozzle row KN2 overlap.

The independent ejection mode is preconfigured in the following description so that only black nozzle row KN2 of black nozzle row KN1 and black nozzle row KN2, only magenta nozzle row MN2 of magenta nozzle row MN1 and magenta nozzle row MN2 ejects ink, only cyan nozzle row CN2 of cyan nozzle row CN1 and cyan nozzle row CN2 ejects ink, and only yellow nozzle row YN2 of yellow nozzle row YN1 and yellow nozzle row YN2 ejects ink eject ink in area H1. Which nozzle row of each corresponding nozzle row pair ejects ink can be configured by the user.

Describing operation in the independent ejection mode more specifically, the inkjet line printer 1 conveys the recording medium 11 at a predetermined constant speed in the forward conveyance direction YJ1*a* while dots are being formed on the recording medium 11. Conveyance of the recording medium 11 in the forward conveyance direction YJ1*a* continues from the position shown in FIG. 1, and the appropriate nozzles in black nozzle row KN2 eject a specific amount of black (K) ink timed to the position P1 on the recording medium 11 reaching the position P2 of the black nozzle row KN2. As conveyance in the forward conveyance direction YJ1*a* advances and position P1 on the recording medium 11 reaches the position P3 of magenta nozzle row MN2, the appropriate nozzles in magenta nozzle row MN2 eject a specific amount of magenta (M) ink. As conveyance in the forward conveyance direction YJ1*a* advances and position P1 on the recording medium 11 reaches the position P4 of black nozzle row KN1, ink is not ejected from black nozzle row KN1. In addition, when position P1 on the recording medium 11 reaches position P5 of magenta nozzle row MN1, ink is not ejected from magenta nozzle row MN1.

As conveyance in the forward conveyance direction YJ1*a* advances and position P1 on the recording medium 11 reaches the position P6 of cyan nozzle row CN2, the appropriate nozzles in cyan nozzle row CN2 eject a specific amount of cyan (C) ink. As conveyance in the forward conveyance direction YJ1*a* advances and position P1 on the recording medium 11 reaches the position P7 of yellow nozzle row YN2, the appropriate nozzles in yellow nozzle row YN2 eject a specific amount of yellow (Y) ink.

As conveyance in the forward conveyance direction YJ1*a* advances and position P1 on the recording medium 11 reaches the position P8 of cyan nozzle row CN1, ink is not ejected from cyan nozzle row CN1. In addition, when position P1 on the recording medium 11 reaches position P9 of yellow nozzle row YN1, ink is not ejected from yellow nozzle row YN1.

Specific amounts of black (K), magenta (M), cyan (C), and yellow (Y) ink are thus ejected to position P1 on the recording medium 11, and a dot of a specific color is formed at position P1.

In the inkjet line printer 1 according to this embodiment of the invention, the position of the inkjet line head 12 is stationary during the image recording process, and dots are formed and an image is recorded by suitably ejecting ink from the recording head while moving the recording medium 11 relative to the stationary inkjet line head 12.

Figure 2B:
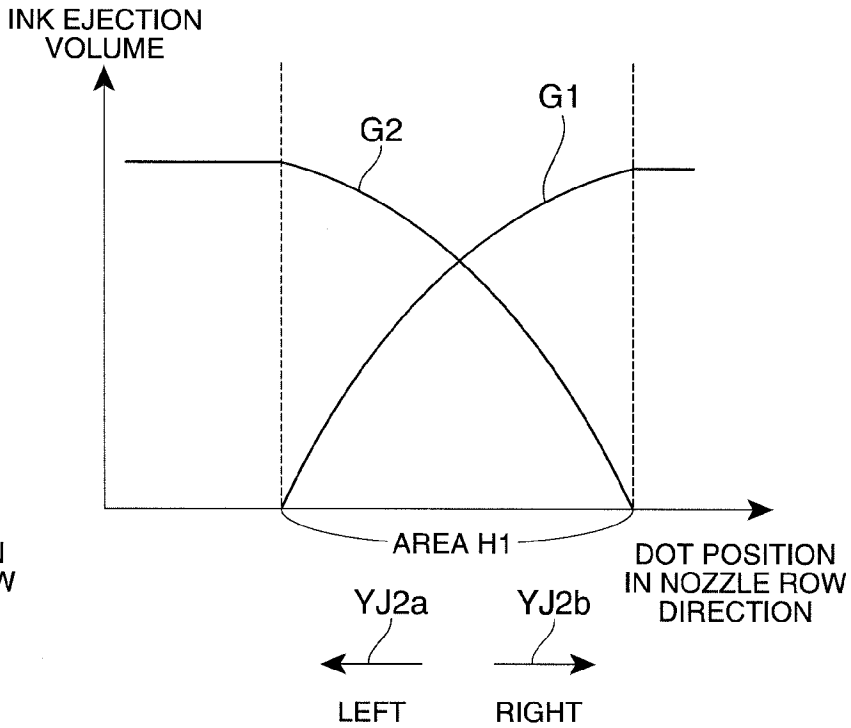
FIG. 2B the change in the ink ejection volume in area H1 in FIG. 1.
Figure 2A:
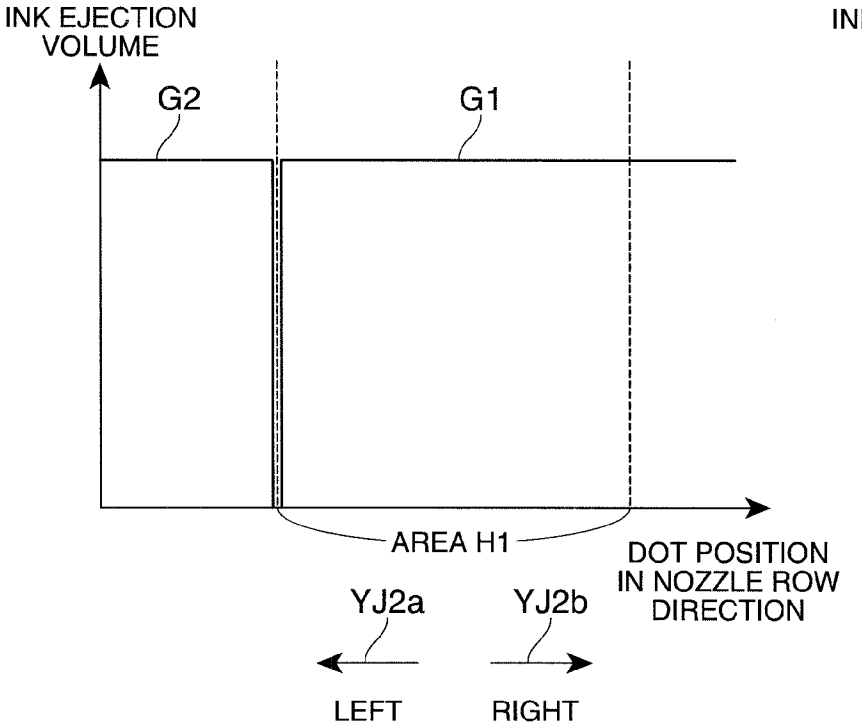
FIG. 2A the change in the ink ejection volume in area H1 in FIG. 1.

FIG. 2A shows the change in the ink ejection volume by black nozzle row KN1 and black nozzle row KN2 in area H1.

In FIG. 2A the x-axis denotes dots on the recording medium 11 in the nozzle row direction YJ2, and the y-axis denotes amount of ink. Line G1 indicates the change in the ink ejection volume in black nozzle row KN2, and line G2 shows the change in the ink ejection volume in black nozzle row KN1. Lines G1 and G2 indicate the change in the amount of ink ejected from each nozzle of each nozzle row when forming a dot of a specific color using black (K) ink.

As shown in FIG. 1, the vector of the nozzle row direction YJ2 to the left in the forward conveyance direction YJ1*a* is referred to below as the left YJ2*a*, and the vector to the right is the right YJ2*b*.

As shown in FIG. 2A, when forming a dot of a specific color in area H1, ink is not ejected from black nozzle row KN1 in area H1 and the amount of ink ejected from the black nozzle row KN2 is constant.

In the area where one nozzle row and another nozzle row of the same color overlap, ink is thus ejected in the independent ejection mode from only one nozzle row and ink is not ejected from the other nozzle row of the same color. The process of adjusting the amount of ink ejected from each nozzle row in the overlapping range is thus easier than in the combined ejection mode described next. For example, the independent ejection mode can be selected as the operating mode when reducing the process load on the CPU is desirable.

Combined Ejection Mode

The combined ejection mode is a mode in which when ink of a specific color is ejected in the area where different nozzle rows that eject the same specific color of ink overlap, a suitable amount of ink is ejected from both nozzle rows. For example, a suitable amount of black (K) ink is ejected from both black nozzle row KN1 and black nozzle row KN2 in the combined ejection mode in area H1 where black nozzle row KN1 and black nozzle row KN2 overlap.

More specifically, when position P1 on the recording medium 11 in FIG. 1 reaches position P2 to position P9 on the inkjet line head 12, suitable amounts of ink are ejected to form a dot of a specific color at position P1.

FIG. 2B shows the change in the ink ejection volume from black nozzle row KN1 and black nozzle row KN2 in area H1.

As shown in FIG. 2B, when a dot of a specific color is formed the amount of ink ejected from black nozzle row KN2 in area H1 gradually decreases to the left YJ2A, and the amount of ink ejected from black nozzle row KN1 gradually decreases to the right YJ2B.

By controlling the amount of ink ejected from each nozzle row in area H1, unevenness in the arrangement of dots in area H1 can be absorbed and formation of so-called white streaks can be desirably prevented. More specifically, as the amount of ink ejected from black nozzle row KN2 decreases to the left YJ2A in area H1, the amount of ink ejected from black nozzle row KN1 increases to the left YJ2A, and uneven change in color due to differences in the amount of ink ejected is not easily produced in the dots in area H1.

The relationship between black nozzle rows and cyan nozzle rows is described next.

When a black (K) dot is formed on the recording medium 11 in this embodiment, black (K) ink is ejected from the appropriate nozzle of the black nozzle row, and a compensating amount of cyan (C) ink is also ejected from the corresponding nozzle of the cyan nozzle row corresponding to the black nozzle row. That a black nozzle row and a cyan nozzle row correspond means that these nozzle rows occupy the same range in the nozzle row direction YJ2, and black nozzle row KN1 and cyan nozzle row CN1 therefore correspond, for example.

The reason why a compensating amount of cyan (C) ink is ejected when black (K) ink is ejected to form a black (K) dot is described next.

When color dropout occurs in a black (K) dot, print quality may drop more significantly than when color dropout occurs in a dot of a different color. However, by ejecting compensating cyan (C) ink when black (K) ink is ejected to form a black (K) dot, this embodiment of the invention forms a compensating dot of cyan (C) ink when there is a problem with a nozzle that ejects black (K) ink, thereby suppressing dot dropout and suppressing a drop in print quality.

As known from the literature, colors with high optical density (OD) are considered to be closer to black (K), and of the colors magenta (M), cyan (C), and yellow (Y), cyan (C) has the highest OD. Therefore, by aligning the position of the black nozzle rows of the upstream head unit 17 with the cyan nozzle rows of the downstream head unit 18, this embodiment of the invention can compensate for black (K) with cyan (C).

Figure 3:
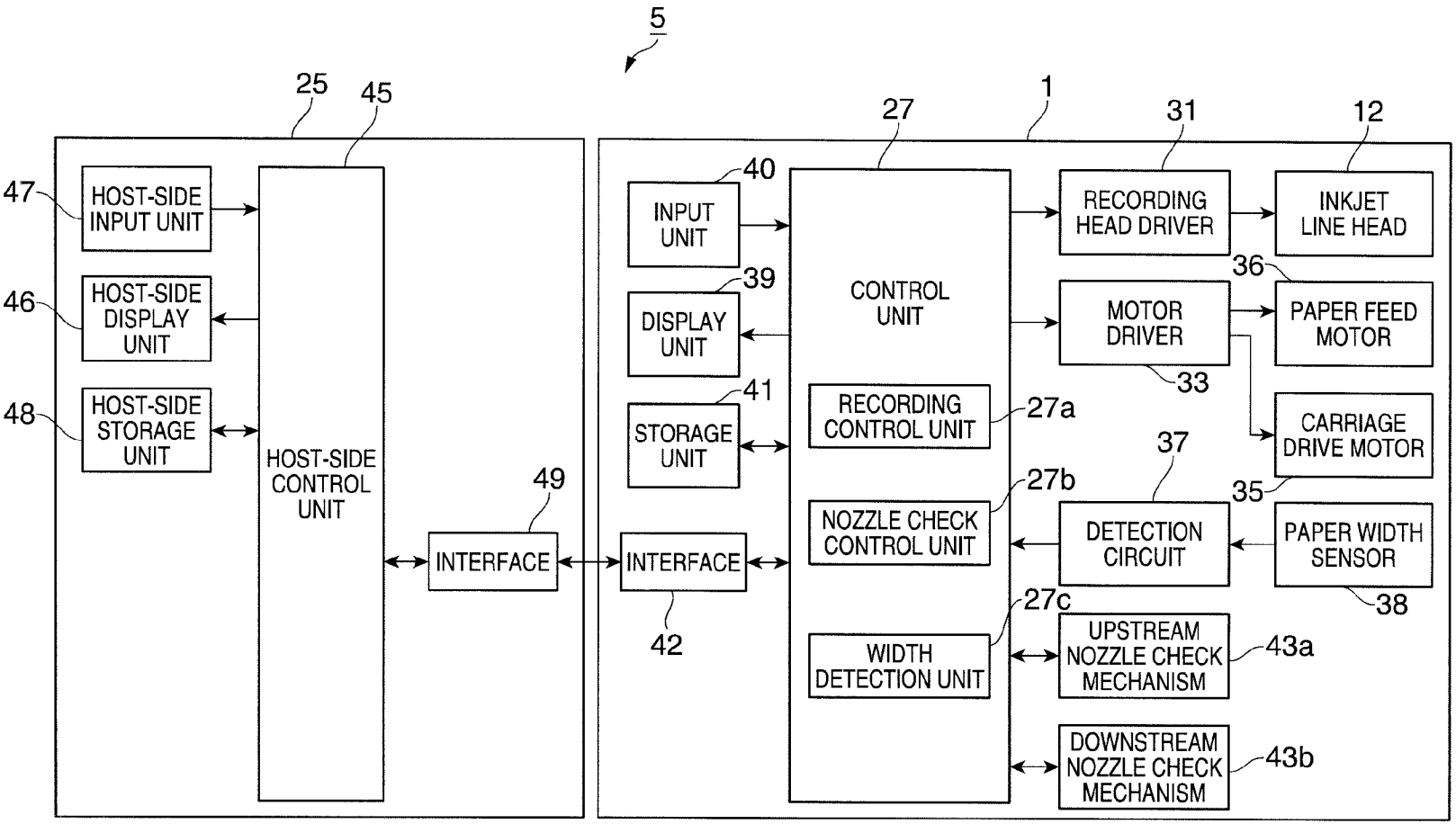
FIG. 3 is a block diagram showing the functional configuration of a recording system.

FIG. 3 is a block diagram showing the functional configuration of a recording system 5 including the inkjet line printer 1 according to this embodiment of the invention and a host computer 25 (control device) that controls the inkjet line printer 1.

As shown in FIG. 3, the inkjet line printer 1 has a control unit 27.

The printer-side control unit 27 centrally controls parts of the inkjet line printer 1, and includes a CPU as an operating unit, a basic control program that can be executed by the CPU, ROM that nonvolatilely stores data related to the basic control program, RAM that temporarily stores programs executed by the CPU and data related to the programs, and other peripheral circuits. The control unit 27 has a recording control unit 27*a*, a nozzle check control unit 27*b*, and a width detection unit 27*c*, and these units are described further below.

The control unit 27 drives the actuators of the recording heads in the inkjet line head 12 through a recording head driver 31, and thus ejects the required amount of ink from each nozzle.

The control unit 27 outputs drive signals to the motors through a motor driver 33 and drives the motors. The motor driver 33 is connected to at least a paper feed motor 36 and carriage drive motor 35. The control unit 27 outputs drive signals to the paper feed motor 36 through the motor driver 33, and drives the paper feed motor 36 to convey the paper a specific amount. As the paper feed motor 36 is driven, the paper feed roller 10 turns, and the recording medium 11 is conveyed a specific amount in the forward conveyance direction YJ1*a* or the opposite direction.

The carriage drive motor 35 is a motor that moves the carriages on which the upstream head unit 17 and downstream head unit 18 are mounted. By driving the carriage drive motor 35 through the motor driver 33, the control unit 27 moves the upstream head unit 17 and downstream head unit 18 from stationary positions KP1, KP2 (FIG. 1) to the home positions HP1 and HP2, or from the home positions HP1 and HP2 to the stationary positions KP1, KP2.

The detection circuit 37 is connected to sensors such as a sensor that detects the temperature of the recording head, a sensor that detects the paper feed state, and a sensor that detects paper jams, applies specific signal processes to the sensor output values, and outputs to the control unit 27. A paper width sensor 38 is connected to the detection circuit 37. The paper width sensor 38 is a sensor that detects the width of the loaded recording medium 11.

The width detection unit 27*c* of the control unit 27 detects the width of the loaded recording medium 11 based on the detection value from the paper width sensor 38. The function of the width detection unit 27*c* is achieved by the cooperation of hardware and software, such as by the CPU executing firmware.

In the following description the recording medium 11 is roll paper, and either recording medium 11 that is 40 mm wide ("40-mm paper" below) or recording medium 11 that is 80 mm wide ("80-mm paper" below) is loaded in the inkjet line printer 1. In this embodiment, the width detection unit 27*c* detects whether the loaded recording medium 11 is 40-mm paper or 80-mm paper based on the output value from the paper width sensor 38. When a value identifying the width of the recording medium 11 is stored in memory in the inkjet line printer 1 or the host computer 25, the width detection unit 27*c* could detect the width of the recording medium 11 by retrieving this setting.

The display unit 39 has a plurality of LEDs, and displays the status of the inkjet line printer 1, whether an error has occurred, and other information by turning specific LEDs on/off as controlled by the control unit 27.

The input unit 40 is connected to switches, and detects and outputs the state of each switch to the control unit 27.

The storage unit 41 is nonvolatile memory such as EEPROM or a hard disk drive, and stores data rewritably.

The communication interface 42 communicates with the host computer 25 according to a specific communication protocol as controlled by the control unit 27. The communication interface 42 and host computer 25 are connected wirelessly or by wire using a known standard such as IEEE 1284, USB (Universal Serial Bus), IEEE 1394, or Ethernet (R).

The upstream nozzle check mechanism 43*a* and downstream nozzle check mechanism 43*b* are described below.

The host computer 25 includes a host-side control unit 45 that centrally controls the parts of the host computer 25, and includes a CPU, ROM, RAM, and peripheral circuits. The host computer 25 also has a display unit 46 that displays information, an input unit 47 that detects user input, a storage unit 48 that stores data, and a communication interface 49 for communication with the inkjet line printer 1.

A printer control driver for controlling the inkjet line printer 1 is installed to the host computer 25. To execute a recording operation on the inkjet line printer 1, the host-side control unit 45 reads and runs the printer driver to generate control commands causing the inkjet line printer 1 to execute the recording operation, and outputs the generated control commands to the inkjet line printer 1.

The recording control unit 27*a* of the control unit 27 of the inkjet line printer 1 sequentially reads and executes the input control commands to control the inkjet line head 12, paper feed motor 36, and other mechanisms and devices and record an image on the recording medium 11. The function of the recording control unit 27*a* is achieved by the cooperation of hardware and software, such as a CPU reading and running firmware.

The inkjet line printer 1 according to this embodiment of the invention performs a nozzle check before recording an image on the recording medium 11 with the inkjet line head 12.

The basic operation of the nozzle check is described next.

First, the nozzle check control unit 27*b* of the control unit 27 of the inkjet line printer 1 moves the upstream head unit 17 and downstream head unit 18 to the respective home positions HP1 and HP2. This function of the nozzle check control unit 27*b* is achieved by the cooperation of hardware and software, such as a CPU reading and running firmware.

An upstream nozzle check mechanism 43*a* is disposed to home position HP1, and a downstream nozzle check mechanism 43*b* is disposed to home position HP2.

Figure 4:
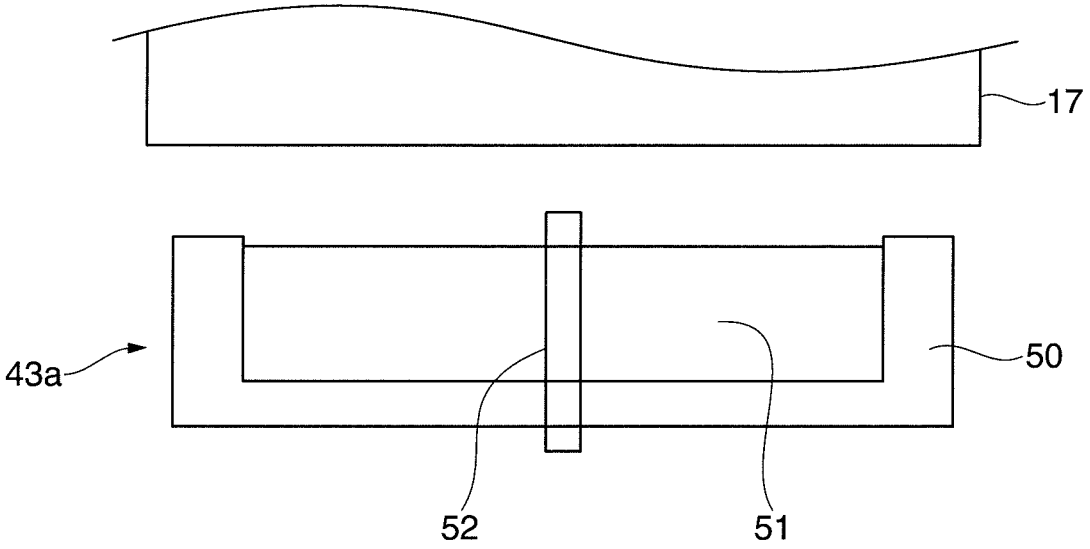
FIG. 4 describes a nozzle check.

FIG. 4 shows the configuration of the upstream nozzle check mechanism 43*a* from the side (horizontally).

As shown in FIG. 4, an absorbent sponge container 50 that is shaped like a box with an open top is disposed directly below the inkjet head 11. An absorbent sponge 51 is held in the sponge container 50, and a conductor 52 is electrically connected to the sponge 51. The sponge 51 covers the entire area of the nozzle surface in which the nozzles of the upstream head unit 17 are formed, and is configured so that ink ejected from any nozzle will land on the sponge 51. Electrical signals flowing through the conductor 52 are output to a specific signal processing circuit. In addition, while not shown in the figure, an electrode for charging the ink ejected from the nozzles is disposed near the nozzles of the upstream head unit 17.

Configured as described above, the nozzle check control unit 27*b* checks each nozzle of the upstream head unit 17 as described below. More specifically, the nozzle check control unit 27*b* ejects a specific volume of ink droplets from the nozzle being checked. The ejected ink droplets land on the sponge 51 after being charged with a specific charge by the electrode. The current state of the conductor 52 changes when the ink droplets land, and a signal representing the change is output through a specific signal processing circuit to the control unit 27. The nozzle check control unit 27*b* determines that the expected amount of ink was ejected normally and there is no ejection problem with the tested nozzle if the value indicated by the input signal exceeds a specific threshold, but if the value is below the threshold, determines that the expected amount of ink was not discharged for some reason and there is an ejection problem with the tested nozzle.

The configuration of the downstream nozzle check mechanism 43*b* is identical to the upstream nozzle check mechanism 43*a*, the method of checking the nozzles of the downstream head unit 18 is the same as the method of checking the nozzles of the upstream head unit 17, and further description thereof is omitted.

Note that because the upstream nozzle check mechanism 43*a* and downstream nozzle check mechanism 43*b* are independent mechanisms in this embodiment, the nozzles of the upstream head unit 17 and the nozzles of the downstream head unit 18 can be checked at the same time. The time required for the nozzle check can therefore be shortened compared with a configuration in which separate mechanisms are not used.

The inkjet line head 12 extends in a direction intersecting the conveyance direction YJ1 of the recording medium 11. The nozzle check mechanisms 43 extend in the conveyance direction YJ1 of the recording medium 11. The inkjet line head 12 are configured to pivot on one end thereof by means of a drive unit not shown, and can move between the recording position intersecting the conveyance direction YJ1 and the nozzle check position aligned with the conveyance direction YJ1. When recording medium 11 is present, the nozzle check can therefore be performed at a position away from the recording medium 11.

Note that whether or not the nozzles are ejecting normally could alternatively be detected by ejecting ink from the nozzles being tested onto the recording medium 11 to form dots, and then optically reading the dots with a scanner. More specifically, any method that enables testing each nozzle and detecting nozzle ejection problems can be used to perform the nozzle check.

The inkjet line printer 1 according to this embodiment of the invention is configured to perform the nozzle check described above before recording images on the recording medium 11. This prevents recording images when nozzle ejection problems exist, and suppresses loss of print quality and wasting recording medium 11.

When the nozzle check is performed using methods of the related art, a relatively long time is required from the start to the end of the nozzle check because the nozzle check is performed for all nozzles of the inkjet line head 12. Because this can result in delaying the completion of recording images to the recording medium 11, shortening the time required for the nozzle check as much as possible is desirable.

The inkjet line printer 1 according to this embodiment of the invention therefore performs the nozzle check as described below.

Figure 5:
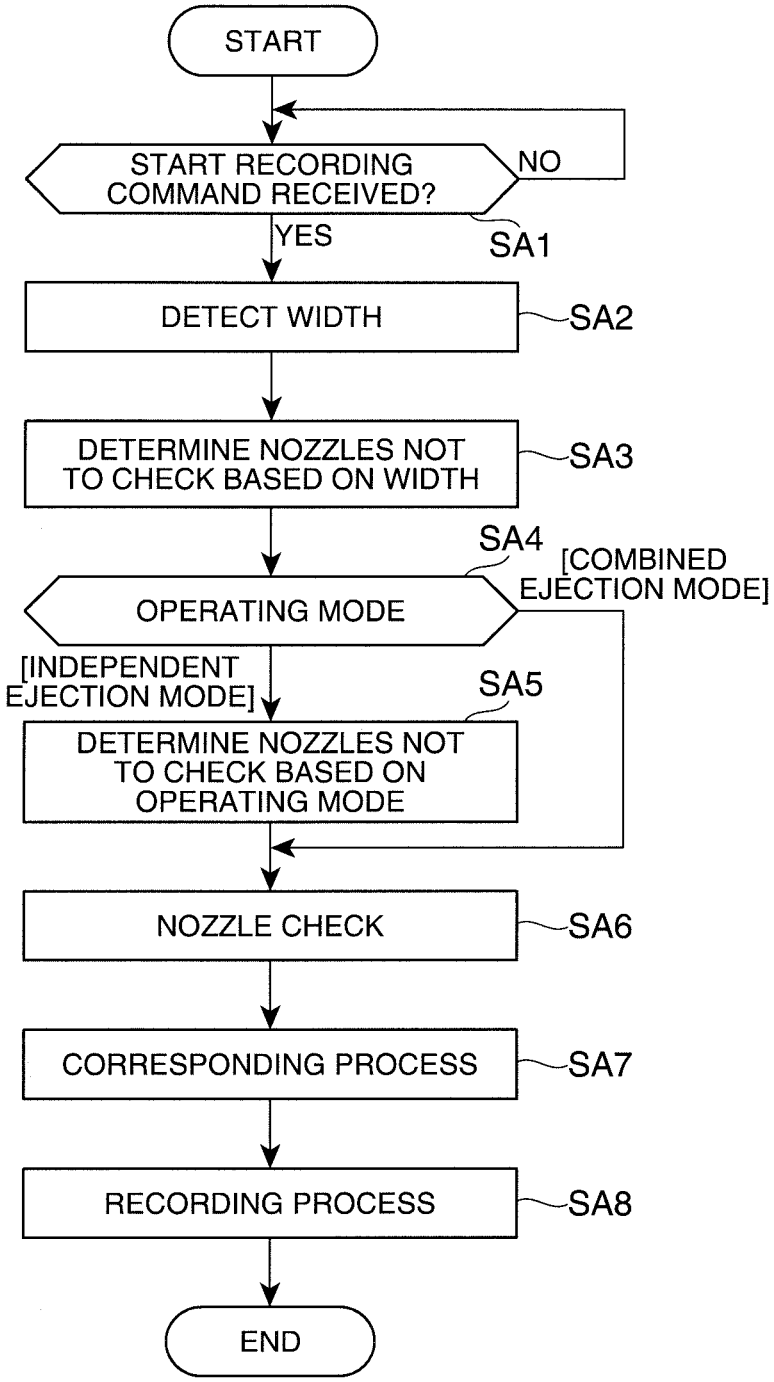
FIG. 5 is a flow chart of inkjet line printer operation.

FIG. 5 is a flow chart showing the operation of the inkjet line printer 1 according to this embodiment of the invention.

As shown in FIG. 5, the control unit 27 of the inkjet line printer 1 watches for a command from the host computer 25 to record an image on the recording medium 11 (step SA1).

If an image recording command is received (step SA1 returns Yes), the width detection unit 27*c* detects whether the loaded recording medium 11 is 40-mm paper or 80-mm paper (step SA2).

The nozzle check control unit 27*b* then determines which nozzles of the inkjet line head 12 will be located outside the area where images will be recorded on the recording medium 11 while recording on the recording medium 11 (step SA3).

The process performed in step SA3 is described below.

Figure 6:
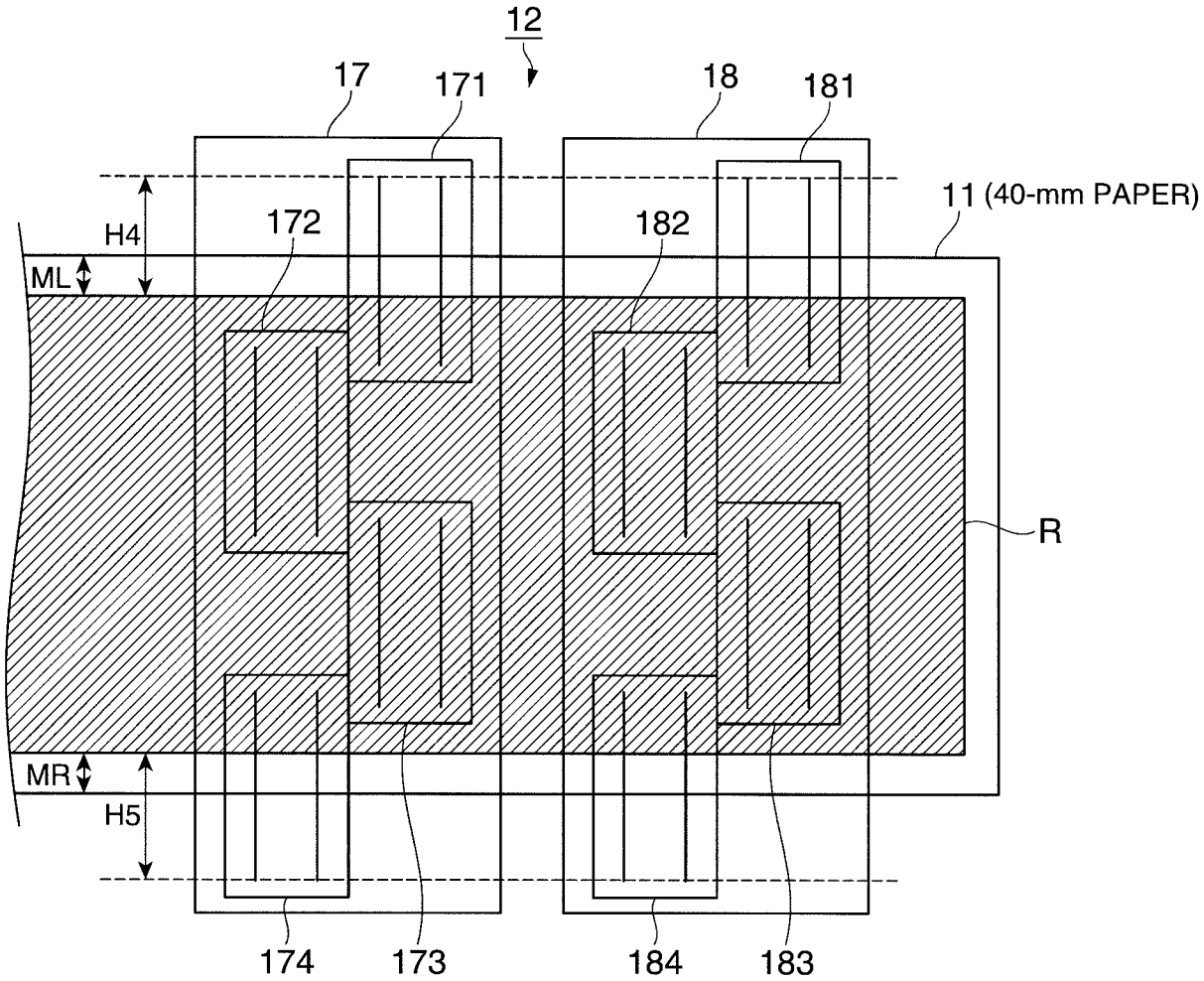
FIG. 6 describes the process executed in step SA2 in FIG. 5.

FIG. 6 shows the relationship between the inkjet line head 12 and 40-mm paper to describe the process of step SA3.

As shown in FIG. 6, a recording area R is formed on 40-mm paper leaving a left margin ML and a right margin MR. This recording area R is the largest area in which an image can be recorded by the inkjet line head 12, that is, the largest area that can be formed by ejecting ink from the nozzles and forming dots.

The nozzles identified by step SA3 as being outside the range of this recording area on the recording medium 11 are the nozzles in area H4 and area H5 outside the range of recording area R in the example shown in FIG. 6. The nozzles in area H4 and area H5 are not used when recording an image on 40-mm paper because they are located outside recording area R during the image recording process.

When 40-mm paper is loaded in this embodiment, the nozzles located outside the range of the recording area of 40-mm paper are previously determined by simulations, and information denoting the identified nozzles is written in the nozzle check program, for example. The same applies to 80-mm paper. As a result, by detecting the width of the loaded recording medium 11, the nozzle check control unit 27*b* can determine the nozzles that are located outside the range of the recording area on each width of recording media 11.

Note that when the left margin ML and right margin MR can be changed by a software settings, for example, the nozzle check control unit 27*b* could determine the nozzles located outside the range of the recording area of the recording medium 11 by executing a program applying a specific algorithm to the margin settings.

The nozzle check control unit 27*b* then determines whether the operating mode is set to the independent ejection mode or the combined ejection mode. The operating mode can be set by the user, and information indicating the user-defined operating mode is stored in a specific storage area in the storage unit 41.

If the operating mode is set to the independent ejection mode (step SA4: independent ejection mode), the nozzle check control unit 27*b* identifies the nozzles that are not used for image recording in the range where different nozzles of the same color overlap (step SA5).

In the independent ejection mode as described above, in the range where one nozzle row and another nozzle row of the same color overlap, ink is ejected from only one nozzle row and ink is not ejected from the other nozzle row of the same color. In step SA5, therefore, the nozzle check control unit 27*b* identifies which nozzles of the nozzle row that is set to not eject ink are in the overlap range.

If the operating mode is set to the combined ejection mode (step SA4: combined ejection mode), the nozzle check control unit 27*b* goes to step SA6.

In step SA6 the nozzle check control unit 27*b* performs the nozzle check.

The nozzle check performed by the nozzle check control unit 27*b* is characterized by the process described below.

Figure 7:
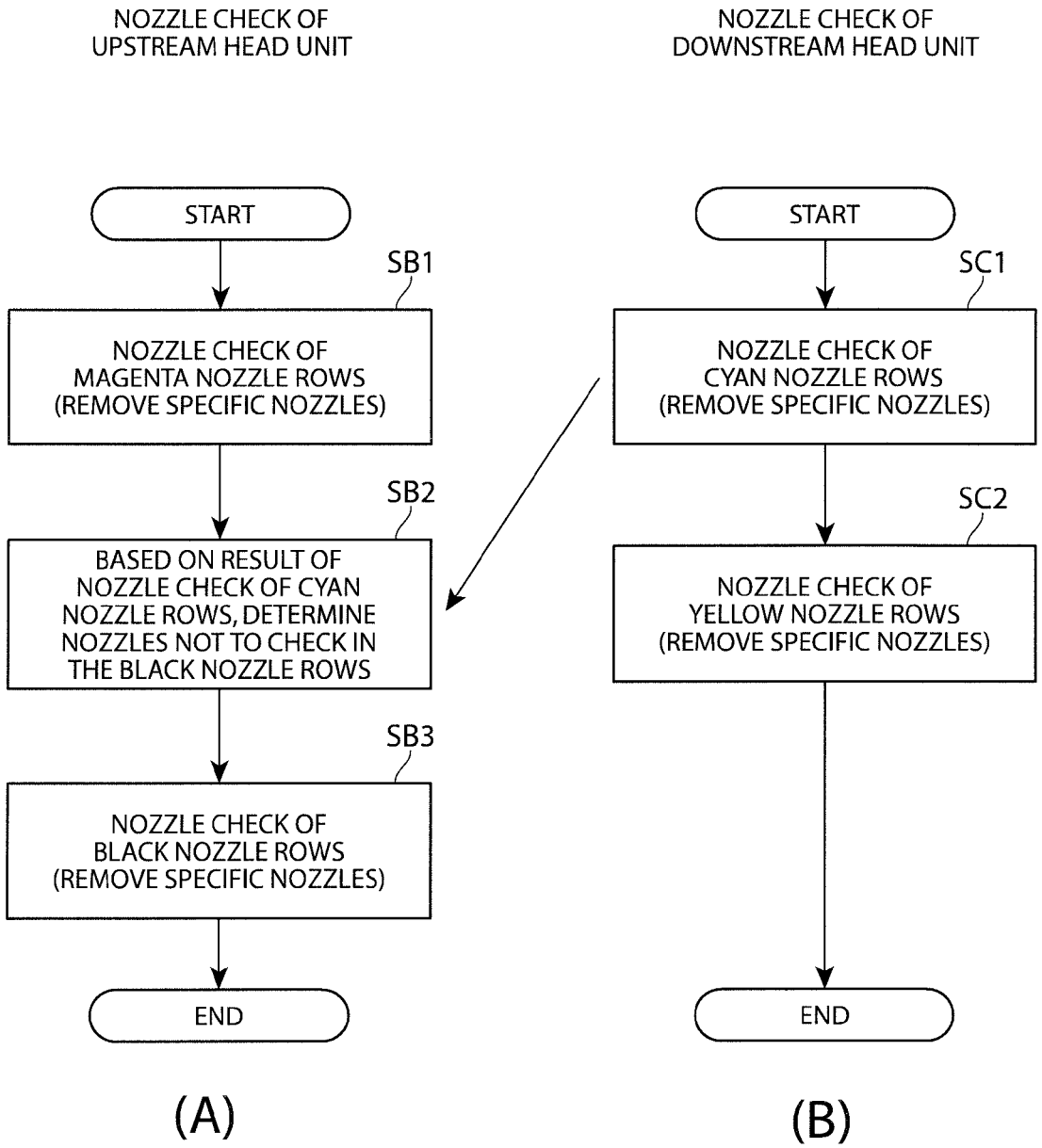
FIG. 7 describes the process executed in step SA6 in FIG. 5.

FIG. 7 describes the flow of the nozzle check performed in step SA6. As described above, nozzle check is simultaneously applied to the upstream head unit 17 and downstream head unit 18. FIG. 7 (A) shows the flow of the nozzle check applied to the upstream head unit 17, and FIG. 7 (B) shows the flow of the nozzle check applied to the downstream head unit 18.

First, the nozzle check control unit 27*b* sequentially checks the nozzles of magenta nozzle rows MN1 to MN4 in the nozzle rows of the upstream head unit 17 (step SB1). At the same time, the nozzle check control unit 27*b* sequentially checks the nozzles of cyan nozzle rows CN1 to CN4 in the nozzle rows of the downstream head unit 18 (step SC1).

In step SB1 and step SC1, the nozzle check control unit 27*b* does not check the nozzles identified in step SA5. This is because these nozzles are nozzles that are not used for image recording, any ejection problems there may be in these nozzles will not affect the print quality of the image, and there is therefore no need to check those nozzles. When the nozzle check is executed before recording an image, this embodiment of the invention thus does not apply the nozzle check to nozzles that are not used to record an image. As a result, the nozzle check is performed without omitting any of the nozzles that are used for recording, a drop in the accuracy of the nozzle check and a drop in reliability can be suppressed, the absolute number of nozzles to be checked can be reduced, and the time required for the nozzle check can be shortened.

Note that the nozzle check control unit 27*b* stores information denoting the results of the nozzle check performed in step SB1 and the results of the nozzle check performed in step SC1 as data ("results data" below) in the storage unit 41. Each nozzle is identified by a unique ID number, and information including at least the ID number of each nozzle where a problem was detected in the nozzle check is included in the results data.

After the nozzle check control unit 27*b* finishes checking the nozzles in cyan nozzle rows CN1 to CN4 in the downstream head unit 18, it checks the nozzles of yellow nozzle rows YN1 to YN4 (step SC2). This step SC2 does not check the nozzles identified in step SA2 and step SA5 in FIG. 5, and the time required for processing is thus shortened.

The nozzle check control unit 27*b* then determines the nozzles in the black nozzle rows KN1 to KN4 of the upstream head unit 17 that will not be checked in the nozzle check (step SB2).

More specifically, when black (K) ink is ejected from a nozzle of a black nozzle row in this embodiment, compensating cyan (C) ink is ejected from the corresponding nozzle of the corresponding cyan nozzle row. Therefore, even if a nozzle of the black nozzle row is not ejecting properly, problems such as missing dots cannot occur at the black (K) dot that should be formed by the defective nozzle because compensating ink is ejected from the nozzle of the cyan nozzle row corresponding to the defective nozzle. This embodiment of the invention therefore does not apply the nozzle check to the corresponding nozzle of the black nozzle row if an ejection problem with the same nozzle of the cyan nozzle row is not detected. A nozzle of the black nozzle row and a nozzle of the cyan nozzle row corresponding means that these nozzles are at the same position in the nozzle row direction YJ2. In the example shown in FIG. 1, the nozzle at position P2 in black nozzle row KN2 and the nozzle at position 6 in cyan nozzle row CN2 are therefore corresponding nozzles, and the nozzle at position P4 in black nozzle row KN1 and the nozzle at position 8 in cyan nozzle row CN1 are corresponding nozzles.

In step SB2, the nozzle check control unit 27*b* references the results data stored in the storage unit 41 and identifies the nozzles of cyan nozzle rows CN1 to CN4 where an ejection problem was not detected, and the nozzles of black nozzle rows KN1 to KN4 corresponding to the nozzles of the cyan nozzle rows where an ejection problem was not detected. The nozzles thus identified are nozzles to which the nozzle check is not applied.

After step SB2, the nozzle check control unit 27*b* applies the nozzle check to the nozzles of the black nozzle rows (step SB3). In this step the nozzle check control unit 27*b* does not check the nozzles identified in step SA2 and step SA5 in FIG. 5, and step SB2 in FIG. 7. This shortens the time required for the nozzle check process. The results of the nozzle check in step SB3 are then stored as results data in the storage unit 41.

Referring again to FIG. 5, after completing the nozzle check in step SA6, the nozzle check control unit 27*b* executes a process based on the results of the nozzle check (step SA7). A process based on the results of the nozzle check may be a process that indicates by means of an LED on the display unit 39 that an ejection problem was detected in at least one of the checked nozzles, a process that outputs information indicating the ID number of the nozzle where an ejection problem was detected to the host computer 25, a process that stops operation of the inkjet line printer 1 when an ejection problem is detected, or some other process that reports when a nozzle with an ejection problem was detected or is appropriate to suppress a drop in print quality or from a failsafe perspective.

The recording control unit 27*a* of the control unit 27 then executes the recording process (step SA8). Because this embodiment shortens the time required for the nozzle check compared with the related art, the time from when a command to record an image on the recording medium 11 is received (step SA1) to the process that actually records the image (step SA8) is shortened, and image recording is completed sooner. This means that the user spends less time waiting, customer satisfaction is improved, and product value is improved.

As described above, the inkjet line printer 1 according to this embodiment of the invention has a recording control unit 27*a* that controls the inkjet line head 12 to record on the recording medium 11, and a nozzle check control unit 27*b* that executes a nozzle check to detect ejection problems in plural nozzles of the inkjet line head 12 before the recording control unit 27*a* records on the recording medium 11. In the nozzle check executed before the recording control unit 27*a* records on the recording medium 11, the nozzle check control unit 27*b* determines which of the plural nozzles are nozzles that will not be used to record on the recording medium 11, and does not apply the nozzle check to those nozzles.

Because the nozzles that do not require checking for ejection problems because they will not be used to record on the recording medium 11 are determined before the nozzle check is run, and the nozzle check is not applied to the identified nozzles, the time required for the nozzle check can be shortened while still assuring the accuracy of the nozzle check by applying the nozzle check to the nozzles that are used for recording on the recording medium 11.

When performing a nozzle check, the nozzle check control unit 27*b* in this embodiment applies the nozzle check to part of the nozzles in the group of nozzles belonging to a specific overlapping range where two nozzle rows overlap each other. More specifically, before performing a nozzle check, the nozzle check control unit 27*b* identifies which of the nozzles in the group of nozzles belonging to a specific overlapping range where two nozzle rows overlap each other are nozzles that will not be used by the recording control unit 27*a* to record on the recording medium 11. Even more specifically, if the operating mode is set to the independent ejection mode when a nozzle check is performed before the recording control unit 27*a* records on the recording medium 11, the nozzle check control unit 27*b* determines which nozzles of the nozzle row that will not eject ink are in the range of overlap, and does not apply the nozzle check to those nozzles.

As a result, the nozzles in a specific range of overlap between two nozzle rows that overlap each other when the nozzle check control unit 27*b* performs the nozzle check are not used for recording on the recording medium 11. Because the nozzle check is not applied to nozzles that do not require checking for ejection problems, the time required for the nozzle check can be shortened while assuring the accuracy of the nozzle check and that the recording head can record. More specifically, because the nozzle check is not applied to nozzles that are not used when the operating mode is set to the independent ejection mode, the time required for the nozzle check can be shortened while assuring the accuracy of the nozzle check by checking the nozzles that will be used for recording on the recording medium 11.

The nozzles of the black nozzle rows and the nozzles of the cyan nozzle rows are in a specific compensating relationship in this embodiment. When an ejection problem is not detected in the nozzle of the cyan nozzle row corresponding to any particular nozzle in the corresponding black nozzle row, the nozzle check control unit 27*b* removes that nozzle in the black nozzle row from the group of nozzles to be checked, and then checks only the other specific nozzles.

This enables shortening the time required for the nozzle check while preventing dot dropout in the black (K) dots.

When performing a nozzle check before recording on the recording medium 11 with the recording control unit 27*a*, the nozzle check control unit 27*b* in this embodiment determines the nozzles that are outside the range of the recording area on the recording medium 11 while recording an image on the recording medium 11 based on the width of the recording medium 11 detected by the width detection unit 27*c*, removes the identified nozzles from the group of nozzles to be checked, and then applies the nozzle check to other specific nozzles.

By thus detecting the width of the recording medium 11, identifying the nozzles that are located outside the range of the recording area on the recording medium 11 when recording an image on the recording medium 11 based on the recording medium 11 width, and not applying the nozzle check to the identified nozzles, the time required for the nozzle check can be shortened while assuring the accuracy of the nozzle check by applying the nozzle check only to the nozzles that are used to record on the recording medium 11.

Another embodiment of the invention is described next.

Figure 8:
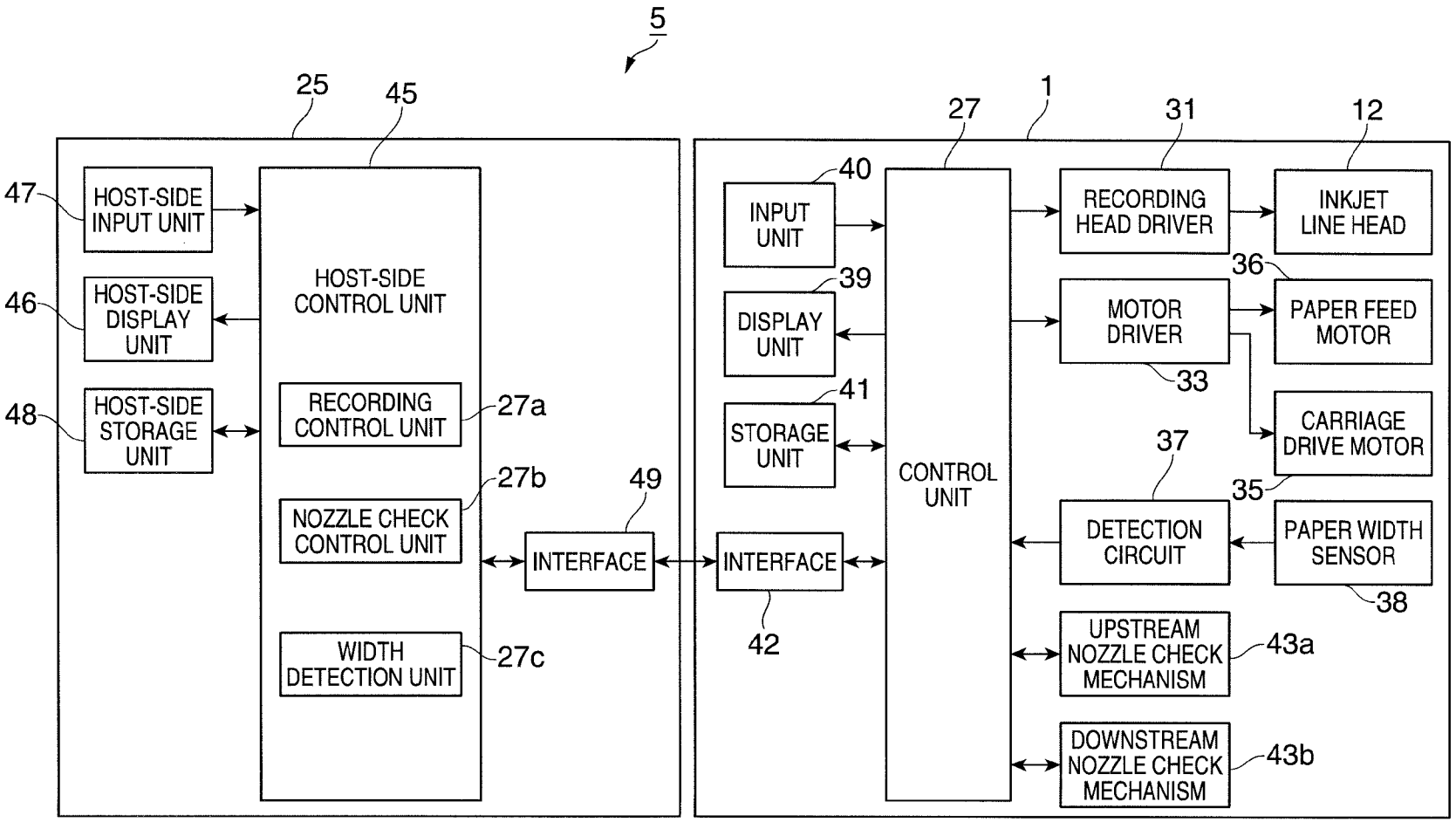
FIG. 8 is a block diagram showing the functional configuration of a recording system according to another embodiment of the invention.

FIG. 8 is a block diagram showing the functional configuration of a recording system 5 according to another embodiment of the invention.

As will be obvious by comparing FIG. 3 and FIG. 8, the host-side control unit 45 of the host computer 25 in this embodiment has the function blocks of the recording control unit 27*a*, nozzle check control unit 27*b*, and width detection unit 27*c*. In this configuration the recording control unit 27*a* of the host-side control unit 45 communicates with the inkjet line printer 1 using the function of a printer driver, for example, and controls recording an image on the recording medium 11. The nozzle check control unit 27*b* also communicates as needed with the inkjet line printer 1 and executes the steps of the flow charts shown in FIG. 5 and FIG. 7 to identify the nozzles of the inkjet line head 12 that are not used to record an image, and applies the nozzle check to the nozzles other than the identified nozzles. The width detection unit 27*c* acquires the detected values output by the paper width sensor 38, and detects the width of the recording medium 11 loaded in the inkjet line printer 1, by communicating with the inkjet line printer 1.

As described in the embodiment above, the process having the effect of shortening the time required for the nozzle check can be executed even when the host computer 25 has the recording control unit 27*a*, nozzle check control unit 27*b*, and width detection unit 27*c*.

The embodiments described above are described for example only, and can be modified and applied as desired without departing from the scope of the accompanying claims.

For example, the foregoing embodiments describe a specific preferred configuration of the inkjet line head 12, but the invention is not so limited. The upstream head unit 17 and downstream head unit 18 could, for example, each have three recording heads in a staggered configuration, or a single recording head extending in the nozzle row direction YJ2.

These embodiments also describe nozzle rows arranged in the sequence black (K), magenta (M), cyan (C), and yellow (Y), but the nozzle rows are not limited to this sequence and can be arranged appropriately according to the configuration of the inkjet line head 12, the design concept, design limitations.

The function blocks shown in FIG. 3 and FIG. 8 can be desirably achieved by the cooperation of hardware and software, and do not suggest any specific hardware configuration.

The functions of the control unit 27 and the host-side control unit 45 could also be provided by a separate device externally connected to the inkjet line printer 1 or the host computer 25.

The steps in the flow charts shown in the figures can also be executed by the control unit 27 reading and running a program stored on an external storage medium.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A recording device comprising:

a conveyance unit configured to convey a recording medium;

a first recording head having a first nozzle row formed with nozzles aligned in a direction intersecting the conveyance direction of the recording medium;

a second recording head having a second nozzle row formed with nozzles aligned in a direction intersecting the conveyance direction of the recording medium, the second nozzle row is configured to eject ink in the same color as the first nozzle row; and a nozzle check control unit configured to perform a nozzle check that detects ejection problems in nozzles of the first nozzle row of the first recording head and nozzles of the second nozzle row of the second recording head;

wherein the first nozzle row and the second nozzle row are disposed separated in the conveyance direction so that the first nozzle row and second nozzle row overlap in a first range in the conveyance direction and do not overlap in a second range in the conveyance direction; and the nozzle check control unit configured to apply the nozzle check to one portion of the nozzles in a group of nozzles in the first range and configured to not apply the nozzle check to another portion of the nozzles in the group of the nozzles in the first range.

2. The recording device described in claim 1, further comprising:

a recording control unit configured to control the first and second recording heads to record on the recording medium;

wherein the nozzle check control unit identifies for the nozzle check the nozzles in the group of nozzles in the first range that are not used by the recording control unit to record on the recording medium, and applies the nozzle check to at least a portion of the nozzles not including the identified nozzles.

3. The recording device described in claim 1, further comprising:

an independent ejection mode in which ink is ejected by nozzles in the first nozzle row in the first range when recording by the recording control unit;

wherein when the independent ejection mode is selected when the nozzle check is performed, the nozzle check control unit applies the nozzle check to at least a portion of the nozzles in the first nozzle row that ejects ink in the first range.

4. The recording device described in claim 1, wherein:

the first recording head further has a third nozzle row for another color that can compensate for the one color disposed separated in the conveyance direction at corresponding positions in the direction intersecting the conveyance direction; and when an ejection problem is not detected in the nozzle with a compensating relationship to a nozzle of the one color, the nozzle check control unit removes the nozzle of the one color from the group of nozzles to be checked, and in the group of nozzles contained in the nozzle row of the one color and the overlapping nozzle row of the other color, applies the nozzle check to a portion of the nozzles in the group of nozzles in the first range.

5. The recording device described in claim 1, further comprising:

a width detection unit configured to detect the width of the recording medium;

wherein the nozzle check control unit identifies the nozzles located outside the range of the recording area on the recording medium based on the recording medium width detected by the width detection unit before performing the nozzle check, and after removing the identified nozzles from the group of nozzles to be checked, applies the nozzle check to a portion of the nozzles in the group of nozzles in the first range of the nozzles contained in the first nozzle row.

6. A method of controlling a recording device comprising:

providing a conveyance unit configured to convey a recording medium, providing a first recording head having a first nozzle row formed with nozzles aligned in a direction intersecting the conveyance direction of the recording medium, and a second recording head having a second nozzle row formed with nozzles aligned in a direction intersecting the conveyance direction of the recording medium, the second nozzle row are configured to eject one color of ink same as the first nozzle row, and providing a nozzle check control unit configured to perform a nozzle check that detects ejection problems in nozzles of the first nozzle row of the first recording head and nozzles of the second nozzle row of the second recording head, wherein the first nozzle row are disposed separated in the conveyance direction so that the first nozzle rows and second nozzle rows overlap in a first range in the conveyance direction and do not overlap in a second range in the conveyance direction, and applying the nozzle check to a portion of the nozzles in a group of nozzles in the first range and not applying the nozzle check to another portion of the nozzles in the group of nozzles in the first range.

7. The method of controlling a recording device described in claim 6, wherein:

the recording device also has a recording control unit configured to control the first second recording heads to record on the recording medium; and the control method further comprises:

identifying for the nozzle check the nozzles in the group of nozzles in the first range that are not used by the recording control unit to record on the recording medium, and applying the nozzle check to at least a portion of the nozzles not including the identified nozzles.

8. The method of controlling a recording device described in claim 6, further comprising:

an independent ejection mode in which ink is ejected by nozzles in the overlapping the first nozzle rows in the first range when recording by the recording control unit;

wherein when the independent ejection mode is selected when the nozzle check is performed, the nozzle check is applied to at least a portion of the nozzles in the nozzle row that ejects ink in the first range of the first nozzle row.

9. The method of controlling a recording device described in claim 6, wherein:

the first recording head further has a third, nozzle row for another color that can compensate for the one color disposed separated in the conveyance direction at corresponding positions in the direction intersecting the conveyance direction; and when an ejection problem is not detected in the nozzle with a compensating relationship to a nozzle of the one color, the nozzle of the one color is removed from the group of nozzles to be checked, and in the group of nozzles contained in the nozzle row of the one color and the overlapping nozzle row of the other color, the nozzle check is applied to a portion of the nozzles in the group of nozzles in the first range.

10. The method of controlling a recording device described in claim 6, wherein:

the recording device also has a width detection unit that detects the width of the recording medium; and the control method has a step of identifying the nozzles located outside the range of the recording area on the recording medium based on the recording medium width detected by the width detection unit before performing the nozzle check, and after removing the identified nozzles from the group of nozzles to be checked, applying the nozzle check to a portion of the nozzles in the group of nozzles in the first range of the nozzles contained in the first nozzle row.

* * * * *